US006932252B2

(12) United States Patent
Simmons

(10) Patent No.: US 6,932,252 B2
(45) Date of Patent: Aug. 23, 2005

(54) DEVICE TO ALLOW PHYSICALLY LIMITED PERSONS TO PUT ON OR REMOVE SOCKS

(76) Inventor: Henry E. Simmons, 239 Piedmont, Port Orange, FL (US) 32129

( * ) Notice: Subject to any disclaimer, the term of this patent is extended or adjusted under 35 U.S.C. 154(b) by 0 days.

(21) Appl. No.: 10/431,605

(22) Filed: May 8, 2003

(65) Prior Publication Data

US 2003/0230605 A1 Dec. 18, 2003

Related U.S. Application Data

(60) Provisional application No. 60/387,576, filed on Jun. 12, 2002.

(51) Int. Cl.[7] ..... A47G 25/80
(52) U.S. Cl. ..... 223/111; 223/112; D2/641
(58) Field of Search ..... 223/111, 112; D2/641

(56) References Cited

U.S. PATENT DOCUMENTS 2,828,057 A * 3/1958 McLauchlan ..... 223/111
3,452,907 A * 7/1969 MacLauchlan ..... 223/111
4,130,226 A * 12/1978 Farrell ..... 223/111
4,637,532 A * 1/1987 Doorenbos ..... 223/111
5,322,199 A * 6/1994 White ..... 223/111
5,706,988 A * 1/1998 Moore ..... 223/111

* cited by examiner

*Primary Examiner*—John J. Calvert
*Assistant Examiner*—James Smith
(74) *Attorney, Agent, or Firm*—Westerman, Hattori, Daniels & Adrian, LLP

(57) ABSTRACT

The device to allow physically limited persons to put on or remove socks includes an elongate U-shaped sock caddy and two rigid elongate pivotal handles. The sock caddy has a rounded base with a projecting heel portion and rounded sidewalls with vertical steps in each along its upper edge. The steps in the sidewalls and heel are located such that a sock is held open to be put on and maintained on the caddy while the sock is positioned on the foot. Each handle is pivotally attached and rotates in relation to the caddy with an adjustable resistance. Each handle has a contoured grip with a deep V-shaped notch in the extreme end that leads to a slot so that either handle may be used as a utensil to remove and retrieve socks and as a shoehorn.

6 Claims, 4 Drawing Sheets

DEVICE TO ALLOW PHYSICALLY LIMITED PERSONS TO PUT ON OR REMOVE SOCKS

CROSS-REFERENCE TO RELATED APPLICATION

This application claims the benefit of U.S. Provisional Patent Application Serial No. 60/387,576, filed Jun. 12, 2002.

BACKGROUND OF THE INVENTION

1. Field of the Invention

The present invention relates to devices for putting on and removing socks and, more specifically, to device to be used by people unable to lean over or bend to the side to put on and remove socks.

2. Description of Related Art

A wide variety of devices have been devised for assisting obese, arthritic, and other persons who have trouble leaning forward or bending to the side to put on and remove socks. These devices commonly include a sock caddy, slide member, trough, or shell to hold a sock open and ready to position on a foot.

Person with limited flexibility often find it difficult to use flexible lines, cords, straps, fabric tapes, or other pliant materials to guide a sock caddy. Additionally, a sock caddy suspended from a flexible line or strap is not useful to a person in a reclined position. The present invention includes elongate rigid handles that solve these problems and aid in taking off socks and putting on shoes.

The present inventor is aware that devices with a sock caddy mounted in a fixed position to one end of a rigid handle require the user to lean and bend more than devices with the caddy pivotally mounted to rigid handles. Also, persons with limited flexibility often have weak grips or unsure manual dexterity making a device with two handles preferable to a device with one handle.

Finally, maintaining a sock on the caddy while it is drawn over the foot and up the leg is a difficulty the present invention overcomes.

A discussion of the present art of which the present inventor is aware, and its differences and distinctions from the present invention, is provided below.

U.S. Pat. No. Des. 310,908, issued Oct. 2, 1990 to Anthony Santore titled, "Combined Shoehorn and Hosiery Donning Aid," shows a one piece device including an elongate handle and a scoop-like sock caddy portion at one end. It would appear from the drawings that the axis of the handle and the caddy are identical. No hinge, pivot, shoehorn, or implement to remove socks is shown.

U.S. Pat. No. Des. 321,427, issued Nov. 12, 1991 to Ford Barrick titled, "Tool for Donning and Removal of Hosiery," shows a one-piece device with a grip projecting at one end from a cylindrical section that, in turn, opens into an elongate semi-cylindrical section which ends in a caddy portion with raised, parallel sidewalls. No hinge, pivot, shoehorn, or implement to remove socks is shown.

U.S. Pat. No. 4,620,737, issued to Sampson D. Sanger titled, "Manually Operable Personal Convenience Implement," describes a device having two arms pivotally secured to each other. Sanger describes the "wedge" on one arm as a sock caddy. The axis of the caddy is fixed parallel to the axis of the arm and no hinge or pivot is described at the wedge end of the arm.

U.S. Pat. No. 3,310,209, issued Mar. 21, 1967 to John Clauss titled, "Device for Facilitating the Putting on of Socks," describes a device using a flexibles trap to maneuver a scoop-like caddy. No hinge, pivot, shoehorn, or implement to remove socks is described.

U.S. Pat. No. 3,401,856, issued Sep. 17, 1968 to Abe Berlin titled, "Hosiery-Donning Device," describes a device with a looped strap to maneuver a tube-like caddy. No rigid. handle, means to secure a sock on the caddy, shoehorn, or implement to remove socks is described.

U.S. Pat. No. 4,260,083, issued Apr. 7, 1981 to Nils O.G. Åslin titled, "Pull-on Device for Socks," describes a device with looped cords to maneuver a sock caddy that includes a soft portion, a stiff central sole portion, and an elongate plate member. No rigid handle, shoehorn, or implement to remove socks is described.

U.S. Pat. No. 4,651,909, issued Mar. 24, 1987 to Gregory Banting titled, "Manually Operable Device for Applying Socks," describes a device that uses a "thread" to maneuver a piece of flexible sheet material used as a sock caddy. No rigid handle, means to secure a sock on the caddy, shoehorn, or implement to remove socks is described.

U.S. Pat. No. 3,853,252, issued Dec. 10, 1974 to Giuseppe M. Scianimanico titled, "Orthopedic Device," describes a device with two parallel rod handles that extend from opposite parallel to that of the caddy. Scianimanico does not describe pivotally attached handles, a shoehorn, or an implement to remove socks.

U.S. Pat. No. 4,238,061, issued to Luigi Marchetti and Sergio Zaglio titled, "Socks or Socks Wear-Helping Utensil," describes a device with a single goose-neck handle on one end of an elongate rod and a semi-cylindrical caddy that is pivotally attached to the opposite end of the rod. Marchetti et al., does not describe dual handles, or a shoehorn.

U.S. Pat. No. 4,637,533, issued to Maurice Black titled, "Footwear Dressing Aid," describes a device with a coupling of flexible material pivotally joining the end of a single elongate rod to a sock caddy. Black does not describe dual handles.

None of the above inventions and patents, taken either singly or in combination, is seen to describe the instant invention as claimed.

SUMMARY OF THE INVENTION

The device to allow physically limited persons to put on or remove socks includes a caddy and two handles. The caddy has an elongate U-shaped sidewall that rises from the base at one end, the toe, and arches toward the opposite end of the caddy. From the top of the arch the edge of the sidewall follows a line parallel to the caddy's base to a vertical step.

At the end of the caddy opposite the toe, a section of caddy base projects rearward forming the heel. The steps in the upper sidewalls and the heel are located such that a sock drawn over the caddy is held open at an angle approximating 45° to the base of the caddy between the steps and the heel.

Flat rectangular flanges extend beyond the heel from each upper sidewall. One end of an elongate handle is pivotally attached to the exterior side of each flange. Each handle can rotate in either direction in relation to the caddy with a resistance that is adjustable at the pivot mechanism.

At the opposite end of each handle from the pivot mechanism is a contoured grip with a width greater than the width of the elongate portion of the handle. A deep V-shaped notch in the extreme end of each grip leads to a slot on the axis of the grip.

Accordingly, it is a principal object of the invention to assist persons with physical limitations that make it difficult or impossible for them put on socks without assistance.

It is another object of the invention to aid said persons to remove and retrieve socks.

It is a further object of the invention to help said persons to put on and take off shoes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a device to help put on and take off socks and shoes, and more specifically relates to a device to assist persons with severe physical limitations to put on or take off socks and shoes without help.

Figure 1:
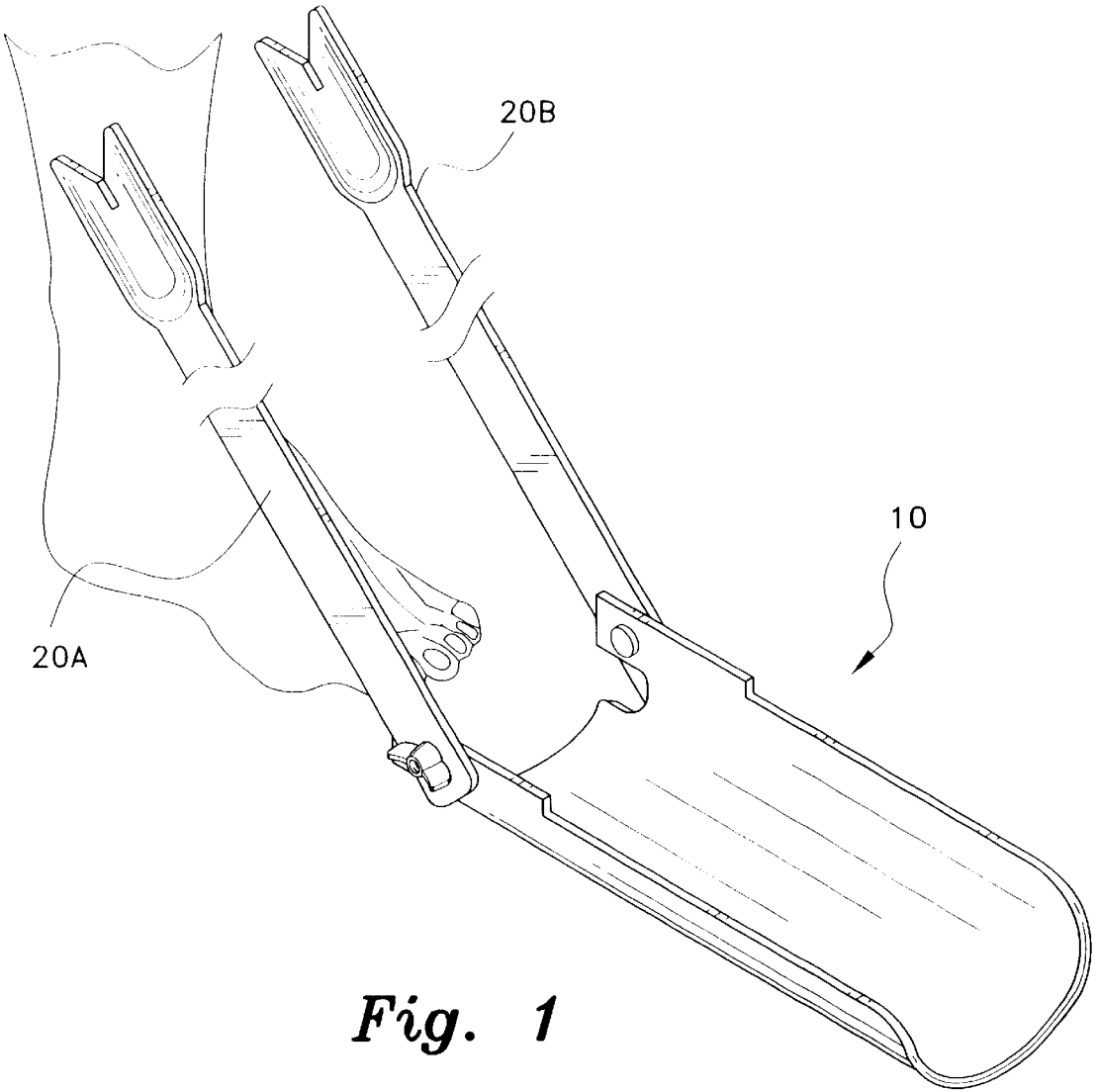
FIG. 1 is a perspective view of a device to allow physically limited persons to put on and take off socks and shoes according to the present invention.

FIG. 1 illustrates an environmental view of the device. The device includes a sock caddy 10 with two handles 20A and 20B.

Figure 2:
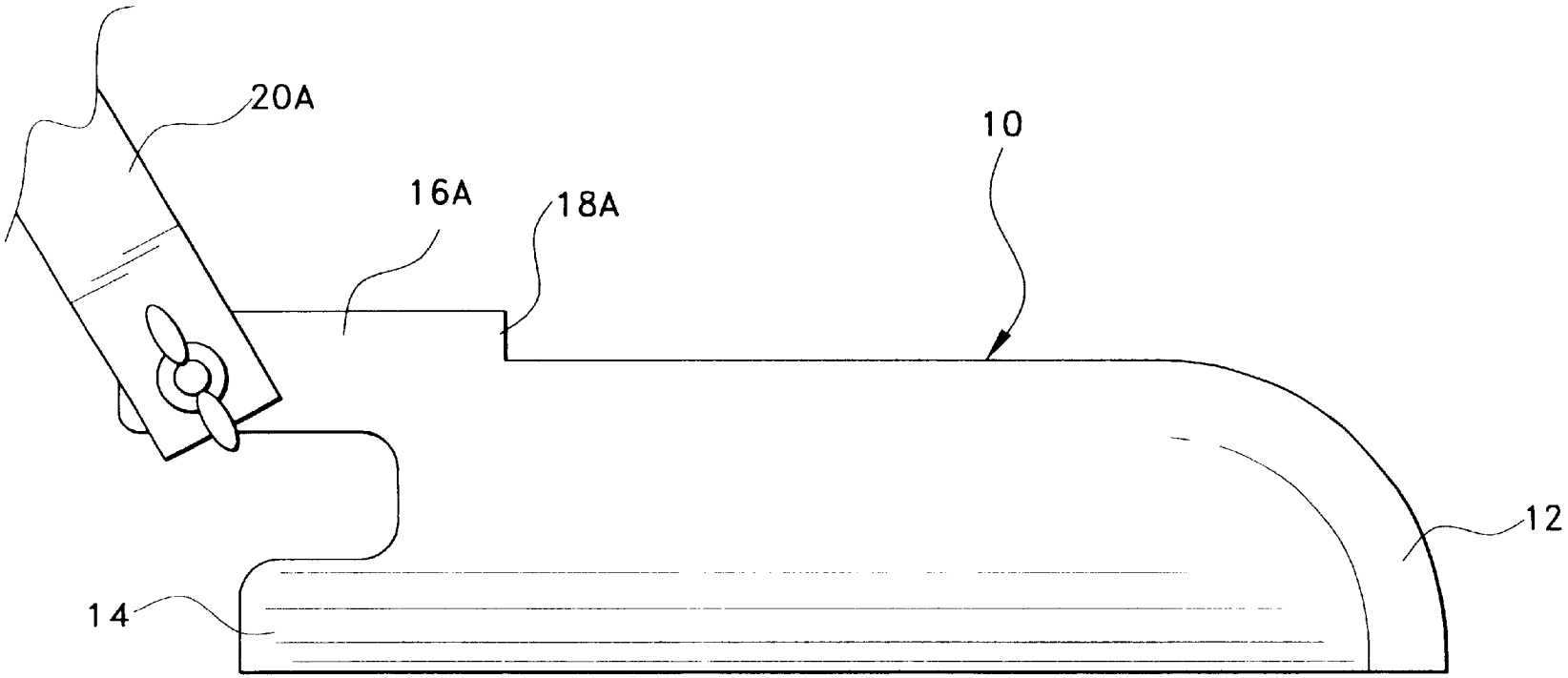
FIG. 2 is a side elevational of a device to put on socks according to the present invention.

As shown in FIG. 2, the sidewalls of the elongated U-shaped caddy 10 arch up and toward the opposite end from the toe 12. From the top of the arch the edges of the sidewalls extend in lines parallel to each other and the axis of the caddy. The sidewall rises vertically at step 18A, and then resumes in a line parallel to the axis of the caddy and at a height greater than the height of the sidewall between the toe 12 and step 18A.

A rectangular flat flange 16A extends from the upper rear sidewall. An elongate flat handle 20A is attached to the exterior sidewall of the flange.

Figure 3:
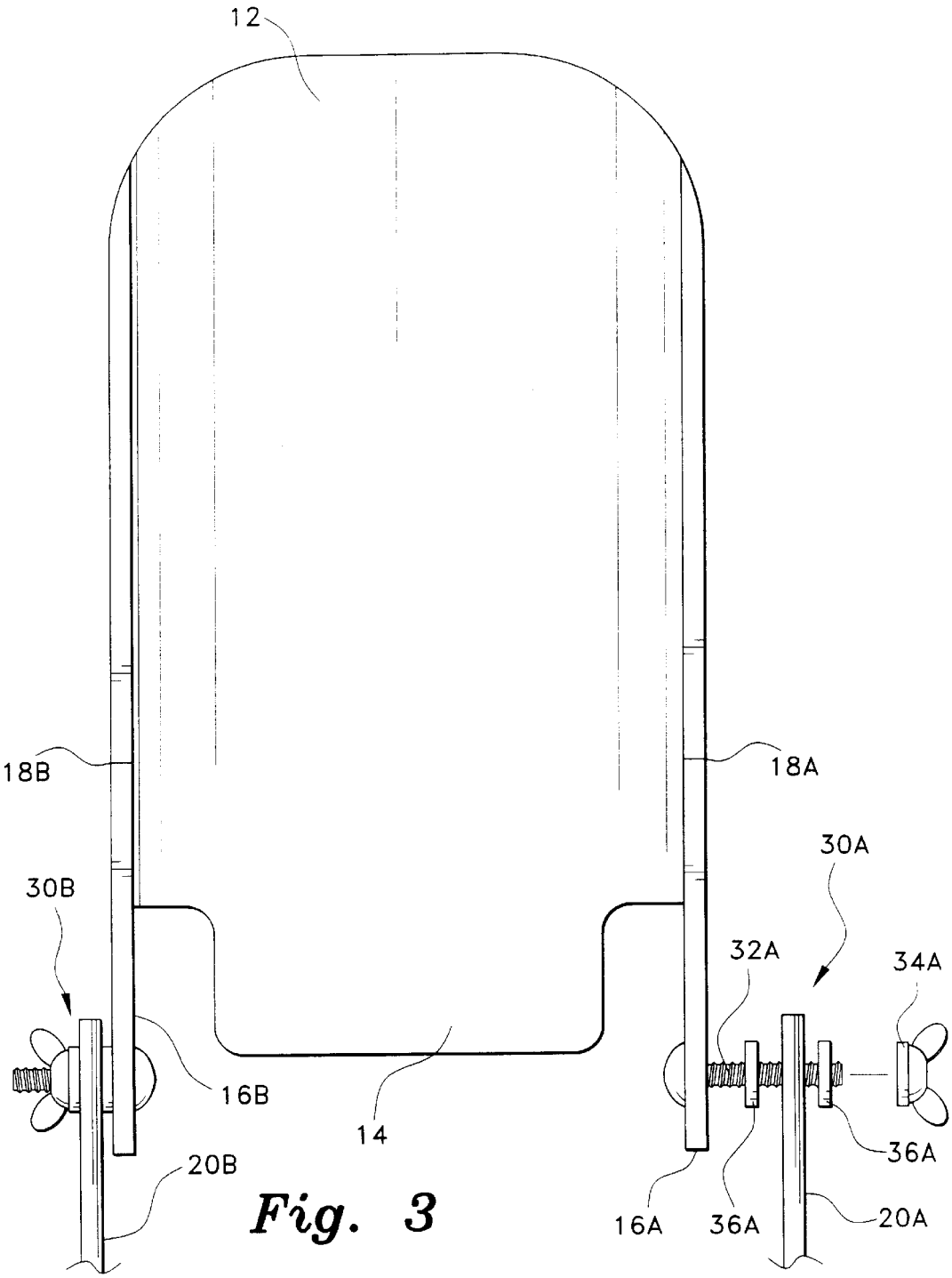
FIG. 3 is a plan view of the device to put on socks according to the present invention.

As shown clearly in FIG. 2 and FIG. 3, the afiermnost section of caddy floor projects rearward from the sidewalls forming a heel 14.

As clearly shown in FIG. 3, flanges 16A and 16B are in substantially parallel planes. The present embodiment shows the lower ends of the flat elongate handles 20A and 20B fastened to the caddy with pivotal attachments 30A and 30B shown in the present invention as a bolt 32A (e.g., a carriage bolt), a wingnut 34A, and two anti-friction bushings 36A. The handles 20A and 20B pivot in substantially parallel planes.

Figure 4:
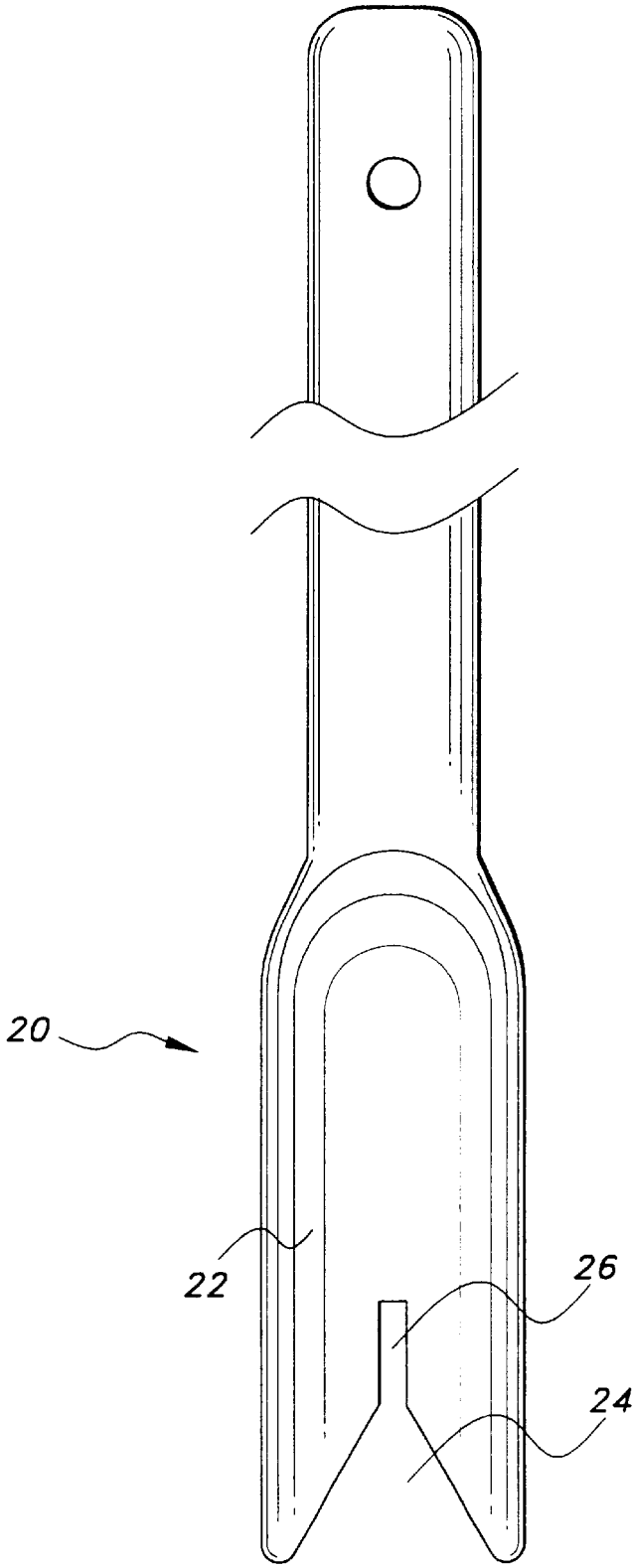
FIG. 4 is a side view of a handle of the device to put on socks according the present invention.

FIG. 4 is a plan view of one of the two identical handle grips 22 that has a greater width than the remainder of the elongate handle 20. A deep V-shaped notch 24 at the end of the grip 22 leads to a slot 26 on the axis of the handle.

In use, a sock is pulled over the caddy toe 12 with the heel of the sock facing down and centered beneath the caddy. The top of the sock is pulled up over the caddy to steps 18A and 18B on the caddy sidewalls and a portion of the sock top is wrapped over the caddy heel 14. Accordingly, the sock is held open at an angle approximating 45° to the base of the caddy.

The handles 20A and 20B are used to place the sock draped caddy in front of a foot. As the foot is moved forward into the sock, a gentle backward pressure is applied to the handles, pivoting as the caddy is drawn from under the heel up the ankle and lower leg. The handles can then be pivoted to rotate the caddy around the leg to extract the caddy from the top of the sock.

Either handle 20 can be easily removed from the caddy to be used as a utensil to remove socks or to use as a shoehorn. To remove a sock, the notch 24 is pushed down over the top edge of a sock catching the lip of the sock in the slot 26 so that it may be easily retrieved after it is pushed down and off the foot.

It is to be understood that the present invention is not limited to the sole embodiments described above, but encompasses any and all embodiments within the scope of the following claims.

I claim:

1. A device for physically limited persons to use with socks comprising:

an elongated U-shaped caddy having a rounded base and two sidewalls, each of the sidewalls having an upper edge;

wherein the two upper edges of the sidewalls each include a vertical step and an extension; the base of the caddy includes a projecting heel extending therefrom; and the U-shaped shaped caddy designed and configured to hold a sock open so as to put the sock on easily;

two elongate rigid handles; and two by pivotal couplings for releasably attaching the handles to the caddy;

wherein the pivotal couplings adjustably allow a resistance to the rotation of each handle relative to the caddy, wherein each handle is easily detachable from the caddy.

2. A system according to claim 1, further comprising an aperture in each extension and the second end of each handle, wherein the pivotal couplings extend through a respective aperture of the extension and the handle so that each handle may be used for sock removal.

3. A system according to claim 2, each pivotal coupling includes a bolt and a wing nut; wherein the resistance to rotation is adjustable by tightening the wing nut on the bolt.

4. A system for assisting persons with limited mobility to put on and take off socks comprising:

an elongated U-shaped caddy having a rounded base and two sidewalls, each of the sidewalls having an upper edge;

wherein the two upper edges of the sidewalls each include a vertical step and an extension; the base of the caddy includes a projecting heel extending therefrom; and the U-shaped caddy designed and configured to hold a sock open so as to put the sock on easily;

two elongate rigid handles;

each handle having a first and second end, the first end comprising a contoured grip including a notch and a slot at the first end; and two by pivotal couplings for releasably attaching each of the second ends of the handles to the caddy, respectively;

wherein the pivotal couplings adjustably allow a resistance to the rotation of each handle relative to the caddy, wherein each handle is easily detachable from the caddy; and wherein one of the grips and respective handles is adapted as a utensil for removing and retrieving socks and as a shoehorn.

5. A system according to claim 4, further comprising a aperture in each extension and the second end of each handle, wherein the pivotal couplings extend through a respective aperture of the extension and the handle.

6. A system according to claim 5, each pivotal coupling includes a bolt and a wing nut; wherein the resistance to rotation is adjustable by tightening the wing nut on the bolt.

* * * * *